US012465104B2

(12) United States Patent
Yuan

(10) Patent No.: US 12,465,104 B2
(45) Date of Patent: Nov. 11, 2025

(54) SEPARABLE AND FOLDABLE MANNEQUIN FOR CLOTHING DESIGN WITH EASY PACKAGING AND TRANSPORTATION

(71) Applicant: Zhuyong Yuan, Qingdao (CN)

(72) Inventor: Zhuyong Yuan, Qingdao (CN)

( * ) Notice: Subject to any disclaimer, the term of this patent is extended or adjusted under 35 U.S.C. 154(b) by 231 days.

(21) Appl. No.: 18/391,672

(22) Filed: Dec. 21, 2023

(65) Prior Publication Data

US 2025/0160463 A1 May 22, 2025

(30) Foreign Application Priority Data

Nov. 22, 2023 (CN) ..... 202311568036.5

(51) Int. Cl.
*A41H 5/01* (2006.01)

(52) U.S. Cl.
CPC ..... *A41H 5/01* (2013.01)

(58) Field of Classification Search
CPC .... A41H 5/01; A41H 5/00; A47F 8/00; F16B 7/182
See application file for complete search history.

(56) References Cited

U.S. PATENT DOCUMENTS 399,181 A * 3/1889 Brown ..... A41H 5/01 223/68
720,231 A * 2/1903 Dargie ..... A41H 5/01 223/68
1,098,965 A * 6/1914 Palmenberg ..... A41H 5/01 223/68
1,102,711 A * 7/1914 Bailey ..... A41H 5/01 223/68
1,351,179 A * 8/1920 Luery ..... A41H 5/01 223/68
9,914,635 B2 3/2018 Guzman et al.
9,918,570 B2 3/2018 Daniels
11,445,838 B1 9/2022 Ruedlinger

* cited by examiner

*Primary Examiner* — Nathan E Durham
(74) *Attorney, Agent, or Firm* — True Shepherd LLC; Andrew C. Cheng

(57) ABSTRACT

In a separable and foldable mannequin for clothing design with easy packaging and transportation, a split-type lifting rod device, a hinge-type foldable assembled fence, and a split-type supporting chassis are effectively used to replace a lifting chassis system, a fixed fence iron frame, and a cast-iron four-legged wheeled chassis used in an existing mannequin. An integral lifting chassis system is improved into the split-type lifting rod device. The split-type lifting rod device can be disassembled into multiple components during packaging, so as to reduce the length of the split-type lifting rod device. The hinge-type foldable upright rods of the hinge-type foldable assembled fence according to the present application are foldable, which can reduce the volume as much as possible during packaging. Therefore, the split-type supporting chassis according to the present application is connected with the split-type lifting rod device by the intermediate connecting member.

10 Claims, 20 Drawing Sheets

SEPARABLE AND FOLDABLE MANNEQUIN FOR CLOTHING DESIGN WITH EASY PACKAGING AND TRANSPORTATION

CROSS-REFERENCE TO RELATED APPLICATIONS

This application is claims priority to Chinese Patent Application No. 202311568036.5, with a filing date of Nov. 22, 2023. The content of the aforementioned application, including any intervening amendments thereto, is incorporated herein by reference.

FIELD

The present application relates to the technical field of mannequins for clothing design, in particular to a separable and foldable mannequin for clothing design with easy packaging and transportation which can reduce a package volume under the condition that an overall size of the mannequin remains unchanged.

BACKGROUND

A mannequin for clothing design whether sold in the international market or in the Chinese market has a large volume and is designed integrally. The overall structure thereof cannot be disassembled or can only be disassembled into large pieces, resulting in the packaging volume of the mannequin being excessively large after packaging during the sales process, which is cumbersome and difficult to transport. Especially in international sales, logistics cost, packaging cost, and storage cost are all very high, directly weakening the competitiveness of a domestic factory.

The mannequin is generally half-length, sometimes may be full-length, and always has a large size. A half-length mannequin has no legs, but has a fixed fence iron frame (a cross section of the iron fame is similar to a waist-shaped hole) with a height of substantially 37 cm, a straight-rod pedal lifting rod, and a chassis. The fence iron frame, the lifting rod and the chassis are integrated, and the chassis is a cast-iron four-legged wheeled chassis. If the mannequin is full-length, the combination of an upper body and a lower body leads to a larger volume, and a higher transportation cost.

At present, separate packaging for this kind of product is used for transportation by the manufacturer in China and other countries. Generally, the mannequin product and the lifting chassis system on the mannequin are disassembled, packaged separately, and transported separately, resulting in a high market price and reducing user interest in using the product. Therefore, it is urgent to provide a new technical solution to solve the problems existing in the conventional technology.

SUMMARY

A separable and foldable mannequin for clothing design with easy packaging and transportation is provided according to the present application, so as to solve the problem of high packaging cost and transportation cost caused by a large packaging volume of the mannequin in the conventional technology.

In order to achieve the above object, the following technical solutions are provided according to the present application.

A separable and foldable mannequin for clothing design with easy packaging and transportation is provided according to the present application, which includes a split-type lifting rod device. The split-type lifting rod device includes an outer tube assembly and an inner tube assembly arranged in the outer tube assembly. The outer tube assembly includes at least two outer tube sections which are detachably connected. An end of the outer tube section located at one end of the outer tube assembly is provided with a bolt fixing gasket for mounting a neck tube. A fixed sleeve is provided on the outer tube section located at the other end of the outer tube assembly, a screw hole is defined on the fixed sleeve, and a through hole corresponding to the screw hole is defined on the outer tube section.

The inner tube assembly includes at least two inner tube sections which are detachably connected. An ejector pin assembly is provided in the inner tube assembly. A first guide gasket which is close to the neck tube is provided at one end of the inner tube assembly, and a third guide gasket is provided at the other end of the inner tube assembly. A threaded connecting sleeve is provided at a connection between two adjacent inner tube sections. The threaded connecting sleeve is located in the inner tube section and a spring is mounted on the threaded connecting sleeve. The inner tube section close to the neck tube includes two splicing sub-tube sections, and a splicing joint of the two splicing sub-tube sections is a slope joint. The ejector pin assembly includes a first ejector pin and a second ejector pin. One end of the first ejector pin is connected with the first guide gasket, the other end of the first ejector pin passes through the threaded connecting sleeve and extends into the spring. The spring abuts against the second guide gasket, the second guide gasket is connected with one end of the second ejector pin, and the other end of the second ejector pin penetrates through the third guide gasket and is connected with a pedal assembly after extending out of the inner tube assembly.

Further, the two adjacent outer tube sections are threadedly connected or are correspondingly connected by insertion.

Further, a screw is mounted in the screw hole of the fixed sleeve, and the screw abuts against an outer wall of the inner tube section.

Further, a slope of the slope joint of the two splicing sub-tube sections is 30°.

Further, connecting ends of the two adjacent inner tube sections are respectively provided with internal threads, external threads corresponding to the internal threads are provided on the threaded connecting sleeve, and the two inner tube sections are detachably connected with each other by the threaded connecting sleeve.

Further, the other end, extending out of the inner tube assembly, of the second ejector pin is adaptively connected with a base, a rotating shaft for mounting the pedal assembly is provided on the base, one end of the pedal assembly is connected with the second ejector pin, and a retaining gasket is provided at a connection between the pedal assembly and the second ejector pin.

The two splicing sub-tube sections abut against each other and are misaligned by sliding along the slope joint when the pedal assembly is in an initial state, so that central axes of the two splicing sub-tube sections are misaligned, an outer wall of the two splicing sub-tube sections abuts against an inner wall of the outer tube assembly to lock the inner tube assembly and the outer tube assembly. The first ejector pin is lifted by the spring when the pedal assembly is stepped downward, so that the two splicing sub-tube sections are separated, the central axes of the two splicing sub-tube sections coincide to unlock the inner tube assembly and the outer tube assembly, and the outer tube assembly is driven to move up and down along the inner tube assembly. The inner tube assembly and the outer tube assembly are locked when the pedal assembly is released, completing the lifting adjustment.

A neck fixing disc is mounted at the end, provided with the bolt fixing gasket, of the outer tube assembly. The neck fixing disc is connected with a mannequin outer housing which covers an outer side of the split-type lifting rod device. A mounting hole for the neck tube to pass through is defined at the center of the neck fixing disc. External threads are formed on an outer wall of the neck tube. A top screw is adaptively connected with the external threads and is configured to fixedly connect the outer tube assembly with the mannequin outer housing. The mannequin outer housing rises or falls with the outer tube assembly when the outer tube assembly is adjusted to rise or fall.

Further, the top screw includes a spherical connecting portion arranged at the bottom of the top screw and a conical connecting portion arranged at a top end of the spherical connecting portion. A top end of the conical connecting portion is hemispherical. The spherical connecting portion and the conical connecting portion form a gourd-shaped structure. Protruding ribs are uniformly provided on an outer wall of the conical connecting portion. Internal threads are formed in the spherical connecting portion and the conical connecting portion.

Further, the separable and foldable mannequin for clothing design with easy packaging and transportation further includes a hinge-type foldable assembled fence which includes multiple annular rings and multiple hinge-type foldable upright rods.

Further, the multiple annular rings are horizontally arranged and are spaced apart vertically.

Further, the multiple hinge-type foldable upright rods are vertically arranged or vertically inclined, multiple hooks for mounting the multiple annular rings are spaced apart on each hinge-type foldable upright rod, and the number of hooks on each hinge-type foldable upright rod is the same as the number of annular rings.

Further, for each hinge-type foldable upright rod, the hinge-type foldable upright rod includes multiple short columns hinged to each other, lengths of the short columns are the same or different, a mounting fixing portion for connecting with the mannequin is formed on the short column located at a top end of the hinge-type foldable upright rod, and the hook for mounting the annular ring is formed on the short column located at a tail end of the hinge-type foldable upright rod.

Further, the mounting fixing portion includes a fixing seat connected at an end of the short column, a threaded connecting hole is defined on the fixing seat, and the fixing seat is tightly connected with the mannequin by a fastening screw.

Further, any two adjacent short columns are hinged to each other, wherein an end of one short column forms a hinge head, and an end of the other short column forms a hinge seat adapted to the hinge head. A mounting groove for mounting the hinge head is defined on the hinge seat, and a mounting hole for mounting a rotating shaft is defined on a groove wall of the mounting groove. A hole for the rotating shaft to pass through is defined on the hinge head. The hole on the hinge head is correspondingly in communication with the mounting hole on the mounting groove to form a passage for mounting the rotating shaft when the hinge head is mounted in the mounting groove.

Further, any two adjacent short columns are rotatable around the rotating shaft, so that an included angle ranging from 90° to 180° is formed between the two adjacent short columns.

Further, the multiple short columns are arranged in a continuous crenellation shape when the included angle of 90° is formed between any two adjacent short columns.

Further, the separable and foldable mannequin for clothing design with easy packaging and transportation further includes a split-type supporting chassis. The split-type supporting chassis includes an intermediate connecting member connected with the bottom of the split-type lifting rod device and multiple supporting foot stands detachably connected with the intermediate connecting member.

Further, the intermediate connecting member includes a central cylinder which forms a plug-in mounting position for the split-type lifting rod device, four connecting supports are uniformly provided on an outer wall of the central cylinder, and one supporting foot stand is mounted on each connecting support.

Further, a mounting dent is defined at an end of the connecting support, the mounting dent is a dent recessed inward from one side surface of the connecting support, and a first connecting hole extending through the connecting support is defined at the bottom of the mounting dent.

Further, one end of the supporting foot stand is provided with a mounting protrusion adaptively overlapped with the mounting dent. A second connecting hole corresponding to the first connecting hole is defined on the mounting protrusion, and the first connecting hole is correspondingly in communication with the second connecting hole to form a mounting passage for mounting a fastening screw when the mounting dent is adaptively overlapped with the mounting protrusion.

Further, the other end of the supporting foot stand is provided with a supporting foot, wherein the supporting foot has a block structure and a horizontal bottom surface.

Compared with the conventional technology, the present application at least has the following beneficial effects.

1. Based on the further analysis and research of the existing technical problems, the present application recognizes that the existing mannequin has a large structural size, and the over volume is still large even if the mannequin product and the lifting chassis system on the mannequin are packaged and transported separately, which leads to the high packaging and transportation costs. Therefore, the lifting chassis system of the existing mannequin is replaced by providing the split-type lifting rod device according to the present application, which improves the integral lifting chassis system into the split-type lifting rod device. The split-type lifting rod device can be disassembled into multiple components during packaging, so as to reduce the length of the split-type lifting rod device, and further reduce the packaging length and packaging volume, thereby facilitating packaging and transportation. The packaging length of the existing mannequin after packaging is substantially 170 cm, while the packaging length of the mannequin mounted with the split-type lifting rod device according to the present application is substantially 95 to 105 cm, and the packaging width and the packaging height are unchanged. Therefore, the separable and foldable mannequin for clothing design with easy packaging and transportation according to the present application greatly reduces the packaging size of the product, reduces the transportation cost, reduces the use cost of the product, improves the use interest of the user, and is beneficial to expanding the market share of the product.

2. The existing fixed fence iron frame is improved into the hinge-type foldable assembled fence according to the present application. The hinge-type foldable assembled fence has a detachable and foldable structure and includes multiple annular rings and multiple hinge-type foldable upright rods. The hinge-type foldable upright rods are vertically spaced apart, and hooks for mounting the annular rings are formed on each hinge-type foldable upright rod. The multiple annular rings are horizontally arranged and are spaced apart vertically. The shape of the hinge-type foldable assembled fence according to the present application is similar to the shape of the existing fixed fence iron frame. However, the hinge-type foldable upright rods of the hinge-type foldable assembled fence according to the present application are foldable, which can reduce the volume as much as possible during packaging, thereby effectively reducing the overall packaging volume and lowering the transportation cost.
3. The existing cast-iron four-legged wheeled chassis is improved into the split-type supporting chassis according to the present application. The split-type supporting chassis includes the intermediate connecting member and the multiple supporting foot stands detachably connected with the intermediate connecting member. The split-type supporting chassis is connected with the split-type lifting rod device by the intermediate connecting member. The detachable design of the intermediate connecting member and the supporting foot stands reduces a horizontal area of the original chassis. During packaging, the split-type supporting chassis is disassembled into multiple small components, thereby reducing the overall packaging volume.
4. The split-type lifting rod device, the hinge-type foldable assembled fence and the split-type supporting chassis are used by the separable and foldable mannequin for clothing design with easy packaging and transportation according to the present application, which successfully replaces the lifting chassis system, the fixed fence iron frame and the cast-iron four-legged wheeled chassis used in the existing mannequin. Modular disassembly can be performed during packaging. The disassembled functional modules can be further disassembled, thereby effectively reducing the packaging volume and transportation cost, and the detachable design structure in the present application is concise and easy to assemble and disassemble. Furthermore, the detachable design can be assembled according to usage requirements, with the length of each part freely set as needed. In addition, the detachable design can replace damaged parts, thereby extending the overall service life of the mannequin and reducing replacement cost.

BRIEF DESCRIPTION OF THE DRAWINGS

In order to illustrate technical solutions in embodiments of the present application more clearly, drawings used in the embodiments are briefly introduced hereinafter. Apparently, the drawings in the following description illustrate only some embodiments of the present application, and other drawings may be obtained by those skilled in the art based on these drawings without any creative efforts. It should be understood that the specific shapes and structures shown in the drawings should not be considered as limitations for realizing the present application in common situations. For example, based on the technical concepts and exemplary drawings disclosed in the present application, those skilled in the art have the ability to easily make routine adjustments or further optimization on the subordination definition/number increasing/number reducing, specific shape, positional relation, connection method, and size proportion relation of some units (components).

Figure 1:
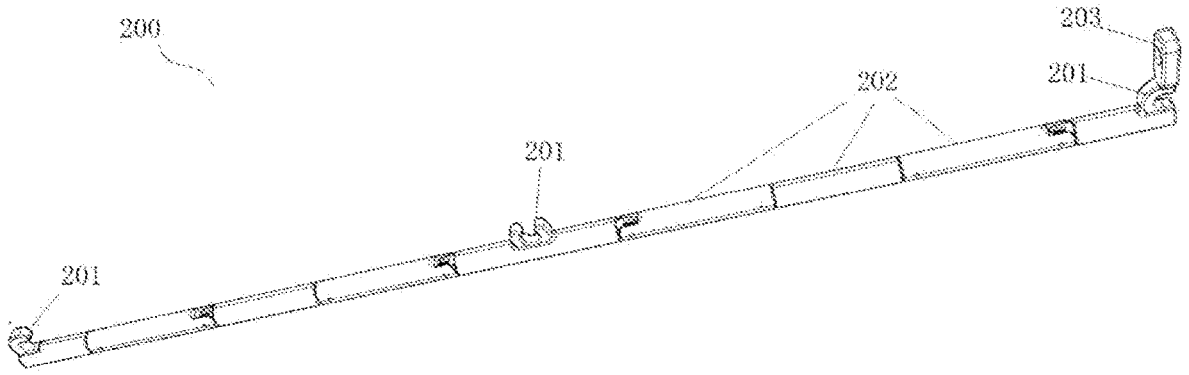
FIG. 1 is a schematic structural view of a hinge-type foldable upright rod according to an embodiment of the present application.

Reference numerals in the drawings are listed as follows: 100 split-type lifting rod device; 101 upper outer tube; 102 lower outer tube; 103 bolt fixing gasket; 104 fixed sleeve; 105 screw hole; 106 upper inner tube; 107 lower inner tube; 108 first guide gasket; 109 threaded connecting sleeve; 110 spring; 111 second guide gasket; 112 third guide gasket; 113 first ejector pin; 114 second ejector pin; 115 retaining gasket; 116 neck tube;

200 hinge-type foldable upright rod; 201 hook; 202 short column; 203 fixing seat; 204 hinge head; 205 hinge seat;

300 split-type supporting chassis; 301 intermediate connecting member; 302 connecting support; 303 supporting foot stand; 304 supporting foot;

400 fixed fence iron frame;

500 mannequin outer housing;

600 top screw; 601 spherical connecting portion; 602 conical connecting portion;

700 neck fixing disc.

DETAILED DESCRIPTION OF THE EMBODIMENTS

The present application is further described in detail through specific embodiments in conjunction with the accompanying drawings.

In the description of the present application, the expression "multiple" or "a plurality of" indicates two or more unless otherwise specified. The terms "first", "second" and "third" used in the present application are intended to distinguish the objects referred to and do not have special meaning in technical sense (for example, the terms should not be understood as emphasizing on importance or order). Expressions such as "including", "containing" and "having" also mean "not limited to" (some units, parts, materials, steps, etc.).

The terms used in the present application, such as "upper", "lower", "left", "right" and "middle", are generally for the convenience of intuitive understanding with reference to the accompanying drawings, and are not absolute limitations on the positional relation in actual product. Without departing from the technical concept disclosed in the present application, these changes in relative positional relations should also be considered as within the disclosed scope of the present application.

In order to solve the problems existing in the conventional technology, a separable and foldable mannequin for clothing design with easy packaging and transportation is provided according to the present application. In the present application, a split-type lifting rod device, a hinge-type foldable assembled fence, and a split-type supporting chassis are effectively used to replace a lifting chassis system, a fixed fence iron frame, and a cast-iron four-legged wheeled chassis used in the existing mannequin, thereby realizing a separable structure design as a whole, which facilitates packaging and transportation, and can effectively reduce the packaging volume.

First Embodiment

A separable and foldable mannequin for clothing design with easy packaging and transportation is provided in this embodiment, which realizes the central support adjustment by using a split-type lifting rod device 100. A mannequin outer housing is mounted on the split-type lifting rod device 100, the bottom of the split-type lifting rod device 100 is connected with a chassis, and the top of the split-type lifting rod device 100 is connected with a neck structure of the mannequin. The split-type lifting rod device 100 can adjust a height of the mannequin. The structure of the split-type lifting rod device 100 in the present application is described in detail hereinafter with reference to FIGS. 14 to 17.

The split-type lifting rod device 100 according to the present application mainly includes: an outer tube assembly and an inner tube assembly arranged in the outer tube assembly. An ejector pin assembly is provided in the inner tube assembly.

Figure 15:
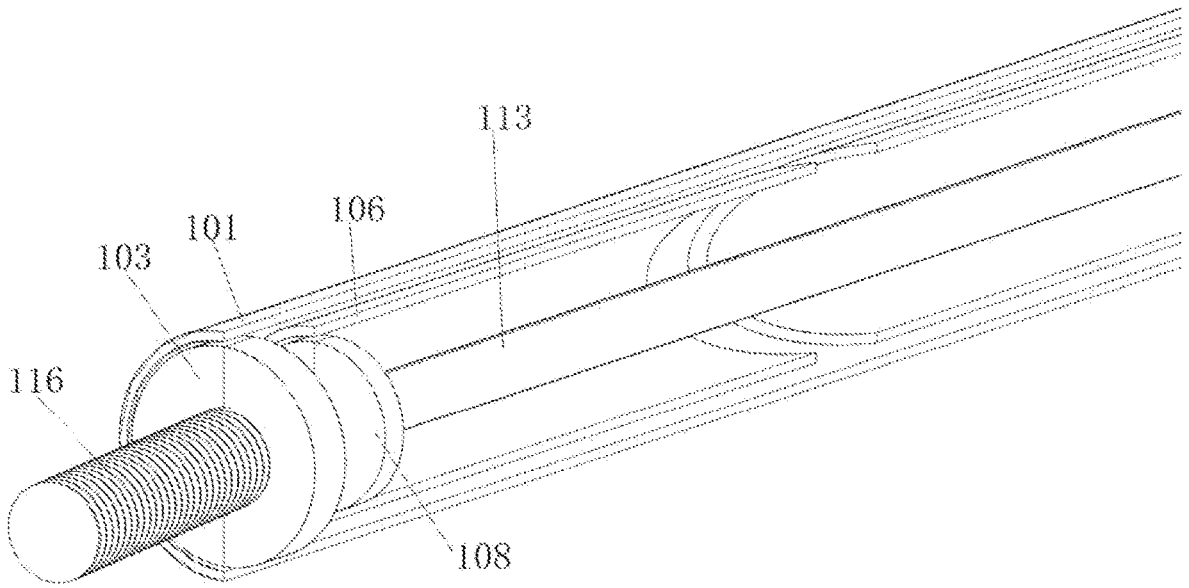
FIG. 15 is a partially enlarged view of portion A in FIG. 14.
Figure 16:
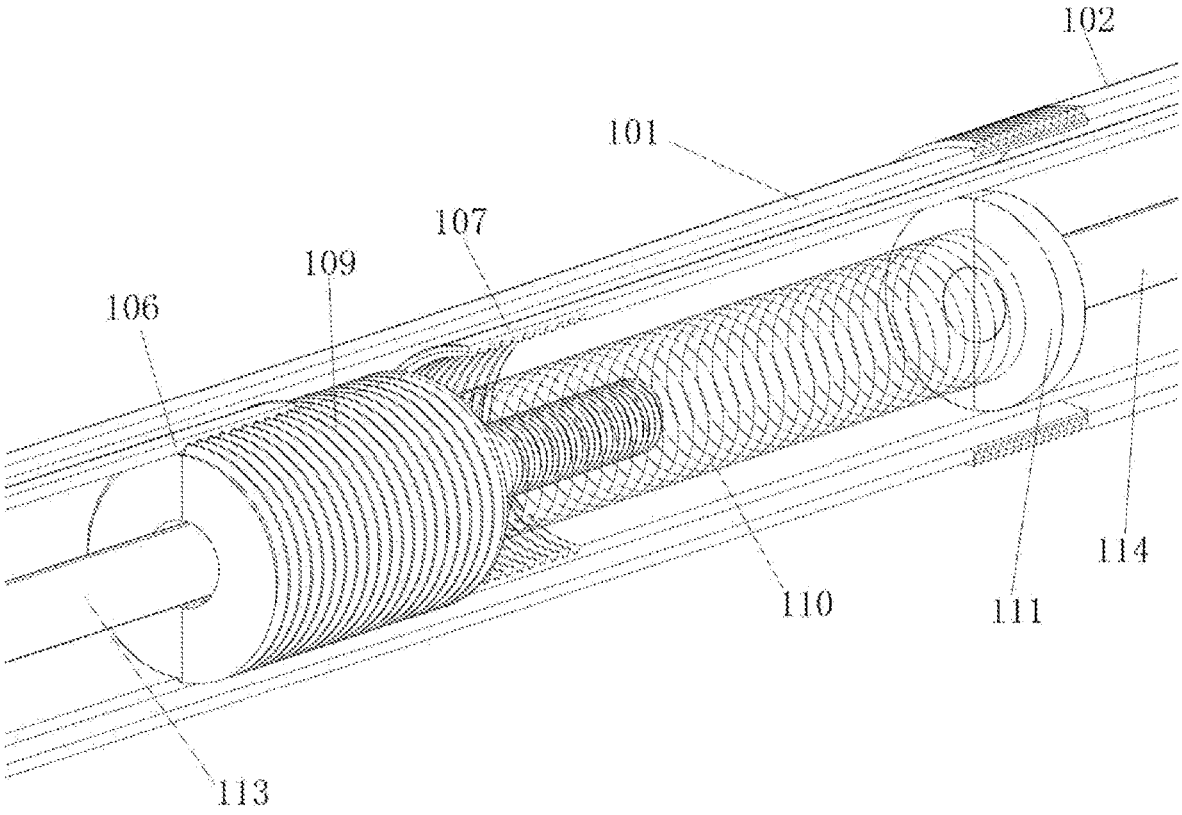
FIG. 16 is a partially enlarged view of portion B in FIG. 14.

In this embodiment, the outer tube assembly includes two outer tube sections which are detachably connected. In other embodiments, the outer tube assembly may include three, four or more outer tube sections which are detachably connected. It can be seen that the more tube sections there are, the more complicated the assembly and disassembly becomes. Therefore, the outer tube assembly herein preferably includes two outer tube sections which are detachably connected. Referring to FIG. 15 and FIG. 16, the two outer tube sections are respectively referred to as an upper outer tube 101 and a lower outer tube 102. A mounting position for mounting a neck tube 116 is reserved at one end of the upper outer tube 101, and the lower outer tube 102 is close to a base.

In this embodiment, a bolt fixing gasket 103 for mounting the neck tube 116 is provided at the end of the upper outer tube 101. A fixed sleeve 104 is provided on the lower outer tube 102, a screw hole 105 is defined on the fixed sleeve 104, and a through hole which is correspondingly in communication with the screw hole 105 is defined on the outer tube section. A screw is mounted in the screw hole 105 of the fixed sleeve 104, and the screw abuts against an outer wall of an inner tube section. The split-type lifting rod device is fixedly connected with the base by the fixed sleeve.

In this embodiment, the upper outer tube 101 and the lower outer tube 102 are threadedly connected or are correspondingly connected by insertion. In a case that the upper outer tube 101 and the lower outer tube 102 are threadedly connected, external threads are provided at an end of the upper outer tube 101, and corresponding internal threads are provided at an end of the lower outer tube 102.

In this embodiment, the inner tube assembly includes two inner tube sections which are detachably connected. In other embodiments, the inner tube assembly may include three, four or more inner tube sections which are detachably connected. It can be seen that the more tube sections there are, the more complicated the assembly and disassembly becomes. Therefore, the inner tube assembly herein preferably includes two inner tube sections which are detachably connected. The two inner tube sections are respectively referred to as an upper inner tube 106 and a lower inner tube 107. The upper inner tube 106 is close to the neck tube 116, and the lower inner tube 107 is close to the base.

In this embodiment, a first guide gasket 108 is provided at one end, close to the neck tube 116, of the upper inner tube 106, and a third guide gasket 112 is provided at one end, close to the base, of the lower inner tube 107.

A threaded connecting sleeve 109 is provided at a connection between the upper inner tube 106 and the lower inner tube 107, and the threaded connecting sleeve 109 is located in the inner tube section and a spring 110 is mounted on the threaded connecting sleeve 109. Connecting ends of the two adjacent inner tube sections are respectively provided with internal threads, external threads corresponding to the internal threads are provided on the threaded connecting sleeve 109, and the two inner tube sections are detachably connected with each other by the threaded connecting sleeve 109.

In this embodiment, referring to FIG. 15, the upper inner tube 106 includes two splicing sub-tube sections, and a splicing joint of the two splicing sub-tube sections is a slope joint. A slope of the slope joint is preferably 30°, or may be 45° or 60°. During the specific production, a hollow tube may be cut into two sub-tube sections with sloping joints and matching cross sections.

Figure 17:
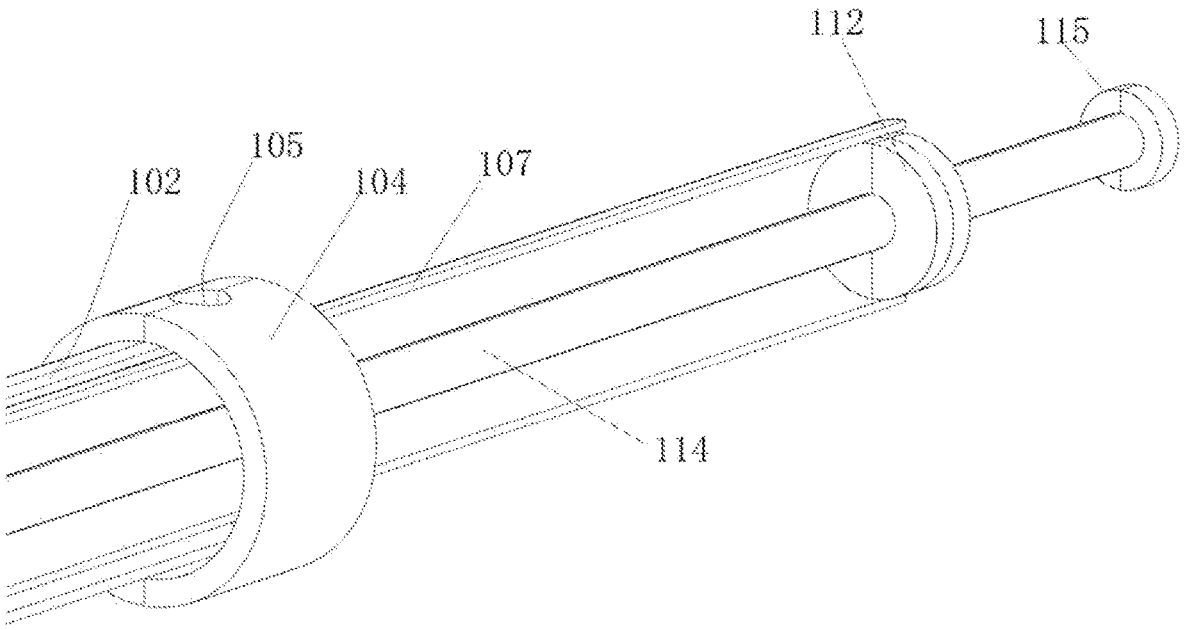
FIG. 17 is a partially enlarged view of portion C in FIG. 14.

In this embodiment, the ejector pin assembly includes two ejector pins, which are referred to as a first ejector pin 113 and a second ejector pin 114. One end of the first ejector pin 113 is connected with the first guide gasket 108, the other end of the first ejector pin 113 passes through the threaded connecting sleeve 109 and extends into the spring 110, that is, the first ejector pin 113 is close to the neck tube 116. The spring 110 is mounted in the threaded connecting sleeve 109 with one end abutting against the second guide gasket 111. The second guide gasket 111 is connected with one end of the second ejector pin 114, and the other end of the second ejector pin 114 penetrates through the third guide gasket 112 and is connected with a pedal assembly after extending out of the inner tube assembly. Moreover, the other end, extending out of the inner tube assembly, of the second ejector pin 114 is adaptively connected with the base. A retaining gasket 115 is provided at a connection between the second ejector pin 114 and the pedal assembly, as shown in FIG. 17.

In this embodiment, a rotating shaft for mounting the pedal assembly is provided on the base, one end of the pedal assembly extends to below the second ejector pin, an end of the second ejector pin penetrates through the base and is connected with the end of the pedal assembly, and the retaining gasket is provided at the connection between the pedal assembly and the second ejector pin. The pedal of the pedal assembly rotates around the rotating shaft when the pedal assembly is stepped downward by the foot, which is similar to the action principle of a seesaw. At this time, the end, connected with the second ejector pin 114, of the pedal assembly rises and lifts the first ejector pin 113 by the spring 110.

The two splicing sub-tube sections abut against each other and are misaligned by sliding along the slope joint when the pedal assembly is in an initial state, so that central axes of the two splicing sub-tube sections are misaligned, an outer wall of the two splicing sub-tube sections abuts against an inner wall of the outer tube assembly to lock the inner tube assembly and the outer tube assembly. The first ejector pin is lifted by the spring when the pedal assembly is stepped downward, so that the two splicing sub-tube sections are separated, the central axes of the two splicing sub-tube sections coincide to unlock the inner tube assembly and the outer tube assembly, and the outer tube assembly is driven to move up and down along the inner tube assembly. The inner tube assembly and the outer tube assembly are locked when the pedal assembly is released, completing the lifting adjustment.

Figure 18:
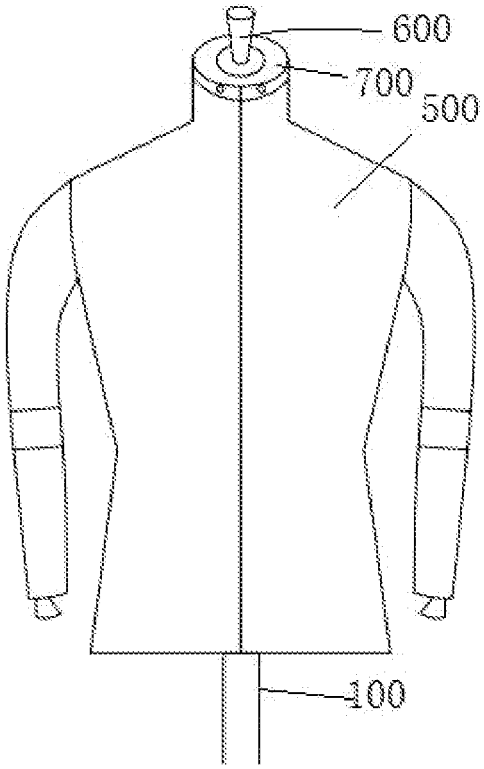
FIG. 18 is a schematic structural view of a mannequin outer housing and the split-type lifting rod device in an assembled state according to an embodiment.

In an embodiment, a neck fixing disc 700 is mounted at the end, provided with the bolt fixing gasket, of the outer tube assembly of the split-type lifting rod device. The neck fixing disc 700 is connected with a mannequin outer housing 500 which covers an outer side of the split-type lifting rod device, as shown in FIG. 18. A mounting hole for the neck tube to pass through is defined at the center of the neck fixing disc 700. External threads are formed on an outer wall of the neck tube. A top screw 600 is adaptively connected with the external threads and is configured to fixedly connect the outer tube assembly with the mannequin outer housing. The mannequin outer housing rises or falls with the outer tube assembly when the outer tube assembly is adjusted to rise or fall.

Figure 19:
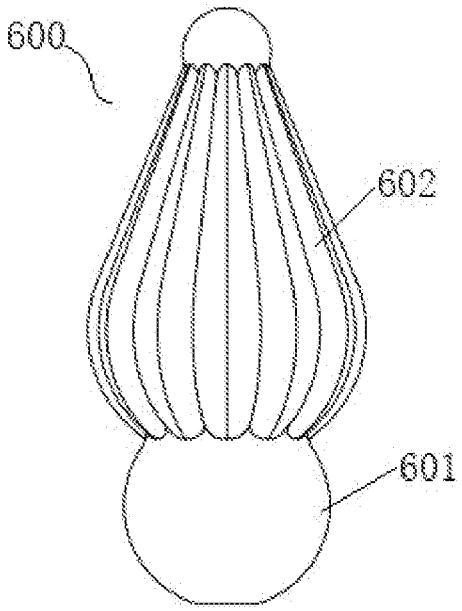
FIG. 19 is a schematic structural view of a top screw in an embodiment.
Figure 20:
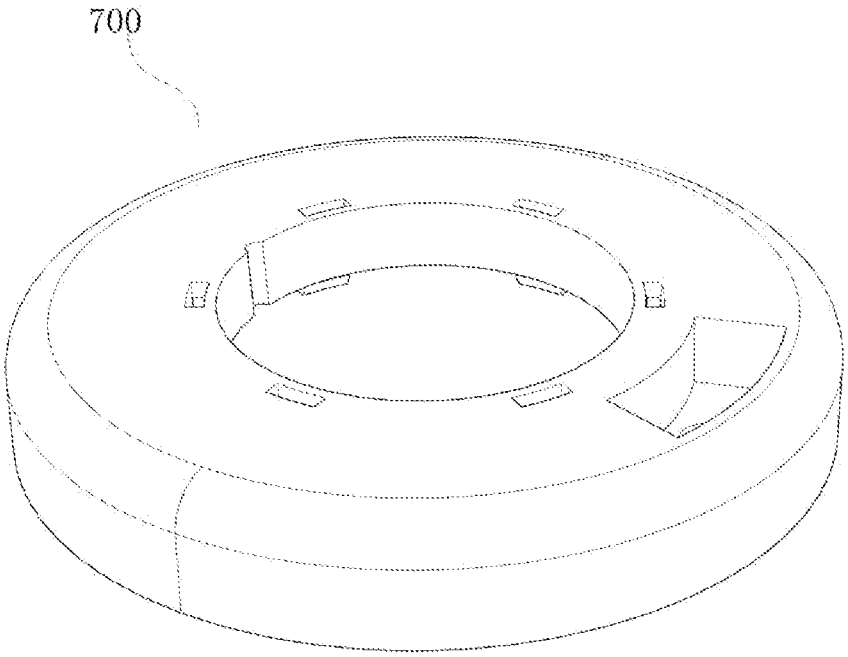
FIG. 20 is a schematic structural view of a neck fixing disc in an embodiment.

Referring to FIG. 19, the top screw 600 includes a spherical connecting portion 601 arranged at the bottom of the top screw and a conical connecting portion 602 arranged at a top end of the spherical connecting portion 601. A top end of the conical connecting portion 602 is hemispherical. The spherical connecting portion 601 and the conical connecting portion 602 form a gourd-shaped structure. Protruding ribs are uniformly provided on an outer wall of the conical connecting portion 602. Internal threads mated with the external threads on the neck tube are formed in the spherical connecting portion and the conical connecting portion. The multiple protruding ribs are longitudinally provided on an outer wall of the conical connecting portion 602 of the top screw 600, as shown in FIG. 19. The conical connecting portion is similar to a flower bud with an aesthetic structure. The external protruding ribs increase the friction and facilitate screwing adjustment.

Therefore, the lifting chassis system of the existing mannequin is replaced by providing the split-type lifting rod device 100 according to the present application, which improves the integral lifting chassis system into the split-type lifting rod device. The split-type lifting rod device 100 can be disassembled into multiple components during packaging, so as to reduce the length of the split-type lifting rod device 100, and further reduce the packaging length and packaging volume, thereby facilitating packaging and transportation. The packaging length of the existing mannequin after packaging is substantially 170 cm, while the packaging length of the mannequin mounted with the split-type lifting rod device 100 according to the present application is substantially 95 to 105 cm, and the packaging width and the packaging height are unchanged. Therefore, the separable and foldable mannequin for clothing design with easy packaging and transportation according to the present application greatly reduces the packaging size of the product, reduces the transportation cost, and also reduces the use cost of the product.

Second Embodiment

Another separable and foldable mannequin for clothing design with easy packaging and transportation is provided in this embodiment on the basis of the first embodiment, and this embodiment includes all the contents of the first embodiment.

In this embodiment, a hinge-type foldable assembled fence is added on the basis of the mannequin provided in the first embodiment. The hinge-type foldable assembled fence is used as the mannequin leg, and plays an auxiliary role in size measurement.

Figure 11:
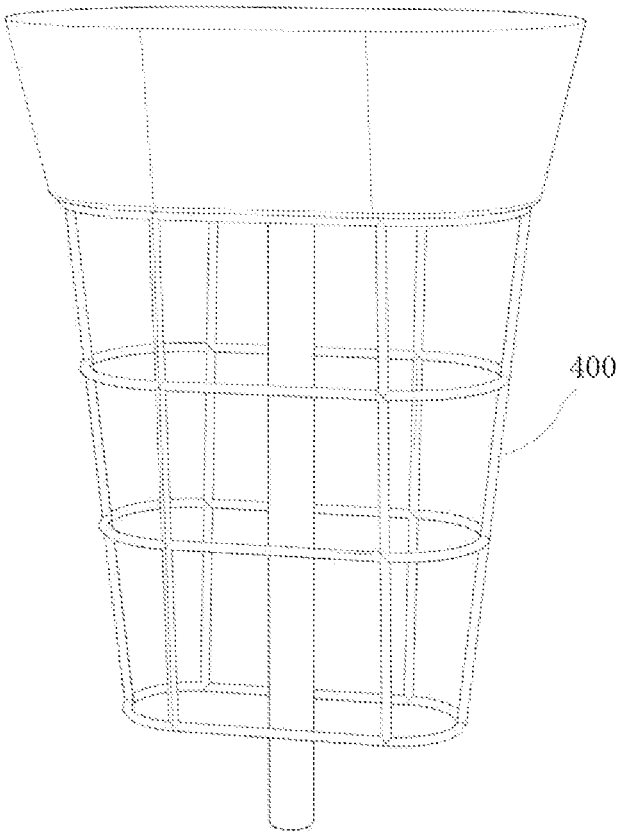
FIG. 11 is a schematic view of a fixed fence iron frame and a mannequin in a connected state in the conventional technology, wherein the fixed fence iron frame is connected below a middle part of a thigh of the mannequin.

FIG. 11 is a schematic view of a fixed fence iron frame 400 and the mannequin in a connected state in the conventional technology. The conventional fixed fence iron frame 400 is replaced by the hinge-type foldable assembled fence according to the present application. The hinge-type foldable assembled fence according to the present application is also connected to the bottom of a middle part of the thigh of the mannequin, which replaces the lower part of the thigh, the knee and the calf, so it can be used as the mannequin leg. The structure of the hinge-type foldable assembled fence according to the present application is described in detail hereinafter.

The hinge-type foldable assembled fence according to the present application includes multiple annular rings and multiple hinge-type foldable upright rods 200. Each annular ring is horizontally arranged, the multiple annular rings are spaced apart vertically, and the multiple annular rings are connected and positioned by the hinge-type foldable upright rods 200 which are vertically arranged or vertically inclined. The hinge-type foldable assembled fence according to the present application after assembly has a hollow cylinder structure with a cross section substantially in the shape of waist-shaped hole or racetrack. The hinge-type foldable upright rods 200 and the annular rings form a mesh structure, which is similar to the shape in FIG. 11.

Figure 2:
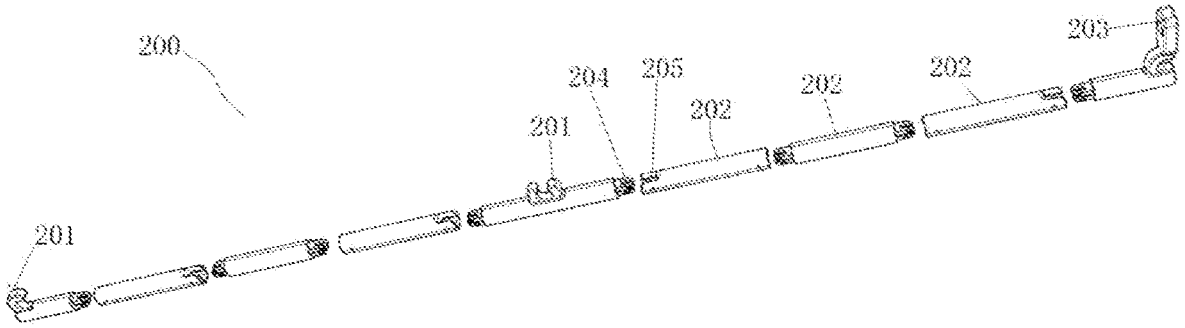
FIG. 2 is a schematic exploded view of FIG. 1.

Referring to FIG. 1 and FIG. 2, multiple hooks 201 for mounting the multiple annular rings are spaced apart on each hinge-type foldable upright rod 200, and the number of hooks 201 on one hinge-type foldable upright rod 200 is the same as the number of annular rings, that is, the multiple hooks 201 on one hinge-type foldable upright rod 200 are spaced apart, one annular ring is hooked by one hook 201, and the assembly and the disassembly of the annular ring and the hook 201 are convenient.

One hinge-type foldable upright rod 200 includes multiple short columns 202 hinged to each other, and the lengths of the short columns 202 may be the same or different.

Figure 3:
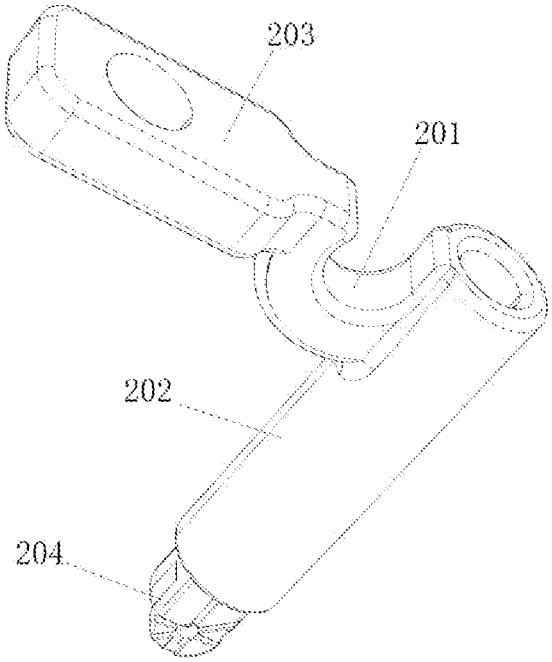
FIG. 3 is a schematic structural view of an end short column of the hinge-type foldable upright rod in FIG. 1.
Figure 4:
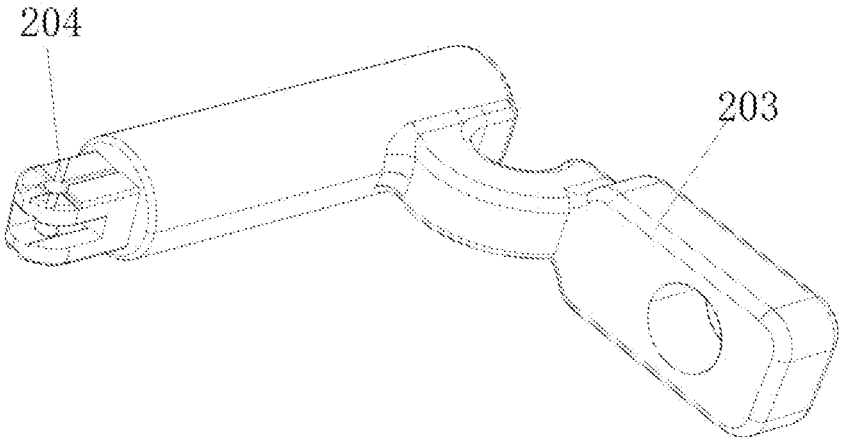
FIG. 4 is a schematic structural view of the short column in FIG. 3 viewed from another perspective.
Figure 5:
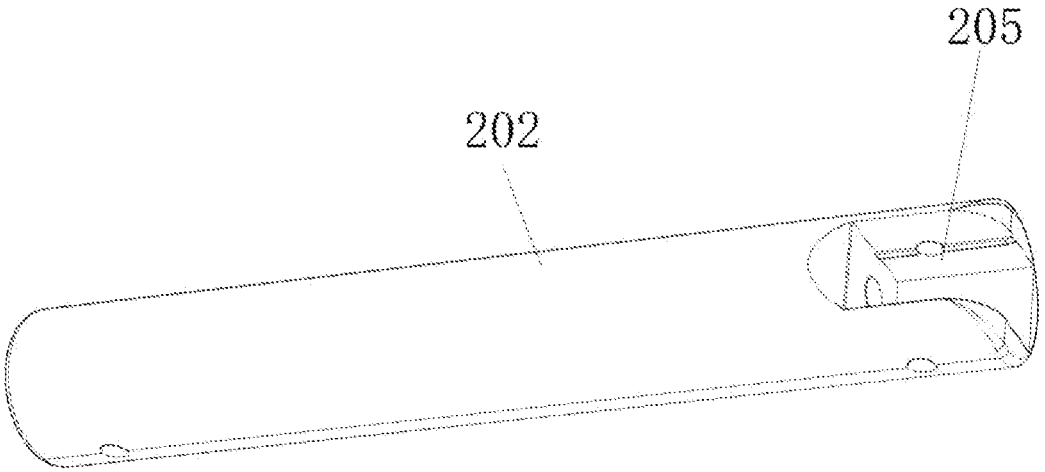
FIG. 5 is a schematic structural view of a middle short column of the hinge-type foldable upright rod in FIG. 1.

Referring to FIG. 3, a mounting fixing portion for connecting with the mannequin is formed on the short column 202 located at a top end of the hinge-type foldable upright rod 200, and the hook 201 for mounting the annular ring is formed on the short column 202 located at a tail end of the hinge-type foldable upright rod 200.

In this embodiment, the mounting fixing portion on the short column 202 includes a fixing seat 203 connected at an end of the short column 202, a threaded connecting hole is defined on the fixing seat 203, and the fixing seat 203 is tightly connected with the mannequin by a fastening screw. The use of fastening screw and threaded connecting hole is only a preferred connection method. In other embodiments, the hinge-type foldable upright rod 200 may be detachably connected with the mannequin by other means such as plugging or clamping.

In this embodiment, any two adjacent short columns 202 of the hinge-type foldable upright rod 200 are hinged to each other, wherein an end of one short column 202 forms a hinge head 204, and an end of the other short column 202 forms a hinge seat 205 adapted to the hinge head 204. A mounting groove for mounting the hinge head 204 is defined on the hinge seat 205, and a mounting hole for mounting a rotating shaft is defined on a groove wall of the mounting groove. A hole for the rotating shaft to pass through is defined on the hinge head 204. The hole on the hinge head 204 is correspondingly in communication with the mounting hole on the mounting groove to form a passage for mounting the rotating shaft when the hinge head 204 is mounted in the mounting groove. Any two adjacent short columns 202 are rotatable around the rotating shaft, so that an included angle ranging from 90° to 180° is formed between the two adjacent short columns 202.

Figure 6:
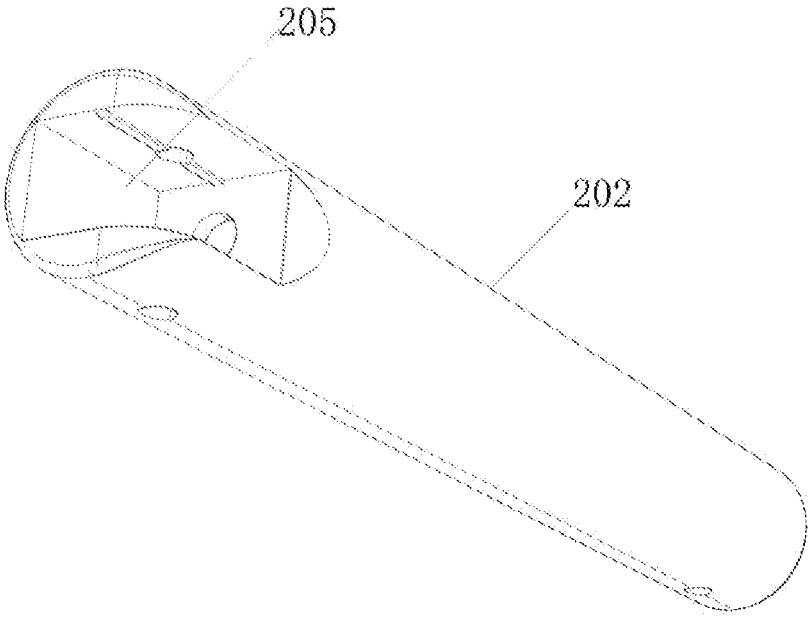
FIG. 6 is a schematic structural view of the short column in FIG. 5 viewed from another perspective.
Figure 7:
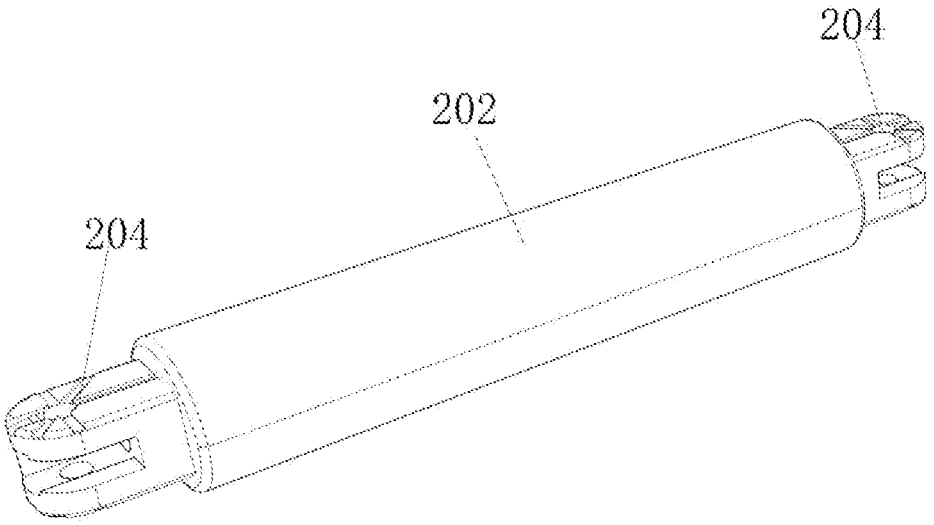
FIG. 7 is a schematic structural view of another middle short column of the hinge-type foldable upright rod in FIG. 1.
Figure 8:
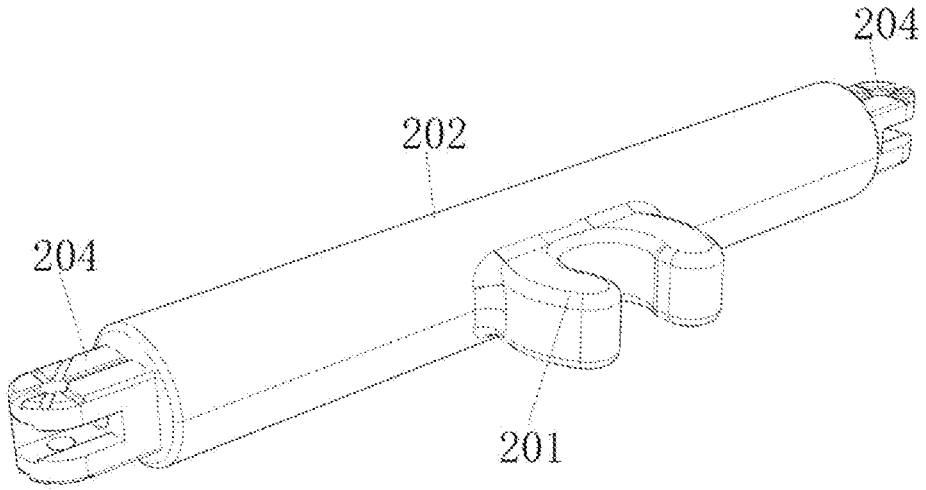
FIG. 8 is a schematic structural view of still another middle short column of the hinge-type foldable upright rod in FIG. 1.
Figure 9:
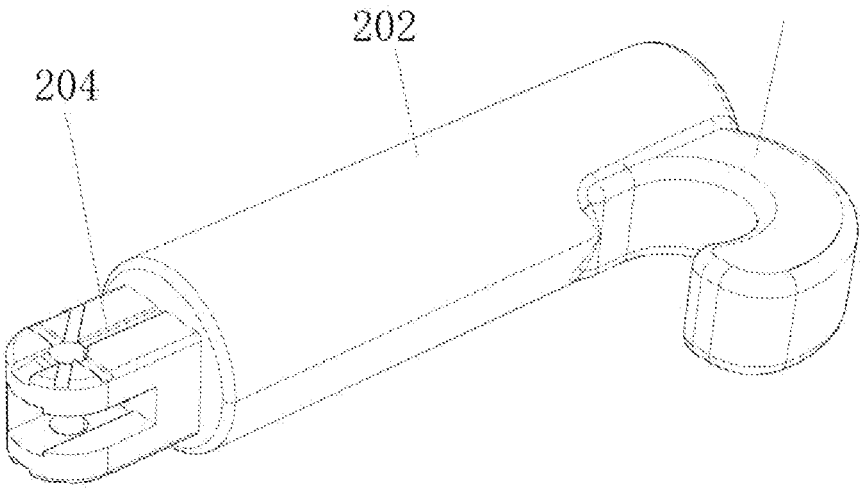
FIG. 9 is a schematic structural view of the other end short column of the hinge-type foldable upright rod in FIG. 1.
Figure 10:
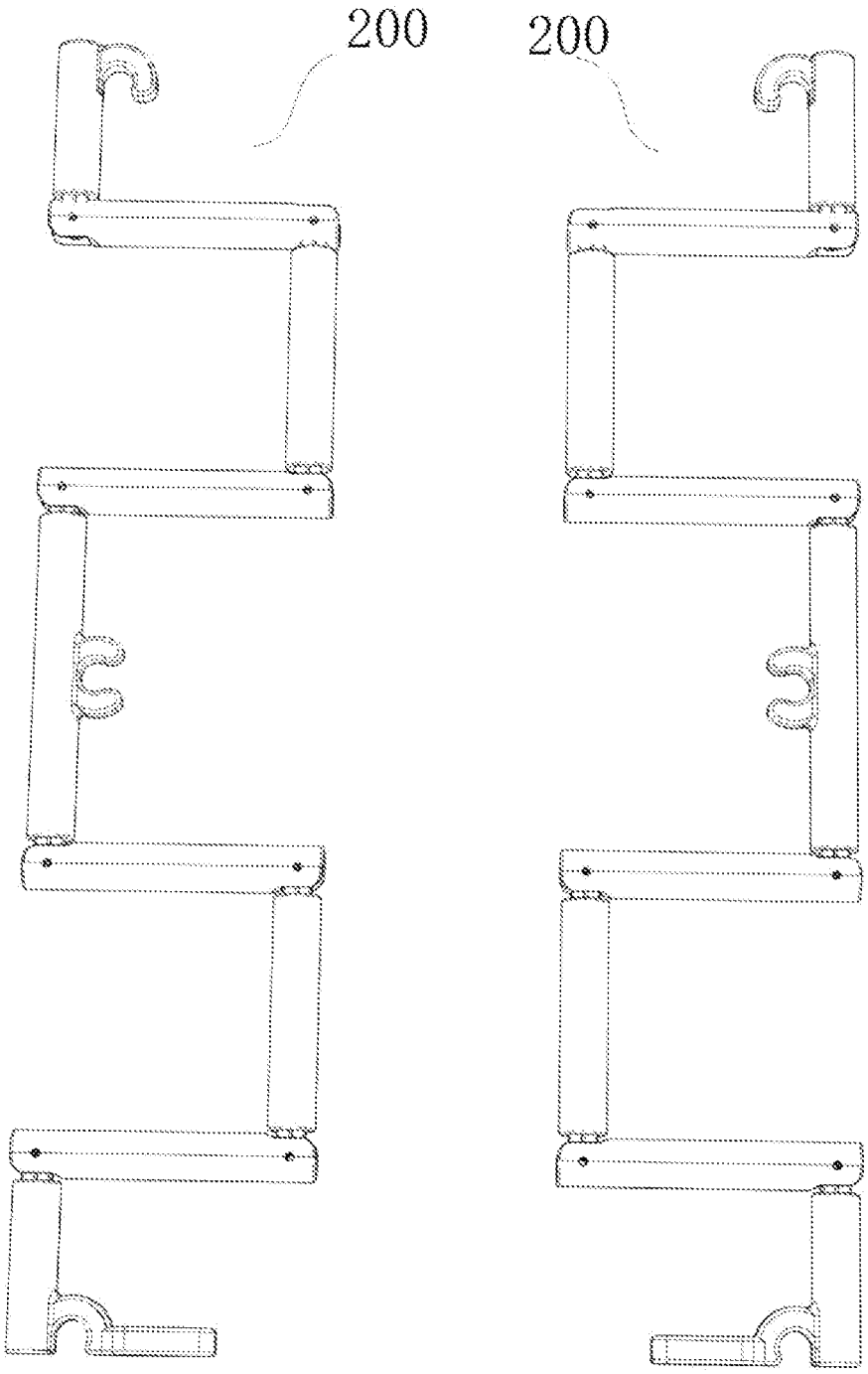
FIG. 10 is a schematic structural view of two hinge-type foldable upright rods in a folded state.

In this embodiment, referring to FIG. 6, an L-shaped opening is defined on the mounting groove defined at the end of the short column 202. The L-shaped opening is formed by the continuous opening formed at the end of the short column 202 and a side wall, close to the end, of the short column 202. The L-shaped opening can ensure that the included angle ranging from 90° to 180° is formed between two adjacent short columns 202, and the short columns are position-limited at two extreme included angles of 90° and 180°.

In this embodiment, each of two ends of one short column 202 is provided with the hinge head 204, each of two ends of the adjacent short column 202 connected with the short column 202 is provided with the hinge seat 205, and the L-shaped openings formed on the two hinge seats 205 on the short column 202 face opposite directions. Therefore, the multiple short columns 202 are arranged in a continuous crenellation shape when the included angle of 90° is formed between any two adjacent short columns 202.

Therefore, the hinge-type foldable assembled fence according to the present application has a detachable and foldable structure and includes multiple annular rings and multiple hinge-type foldable upright rods 200. The hinge-type foldable upright rods 200 are vertically spaced apart, and hooks 201 for mounting the annular rings are formed on each hinge-type foldable upright rod. The multiple annular rings are horizontally arranged and are spaced apart vertically. The shape of the hinge-type foldable assembled fence according to the present application is similar to the shape of the existing fixed fence iron frame 400. However, the hinge-type foldable upright rods 200 of the hinge-type foldable assembled fence according to the present application are foldable, which can reduce the volume as much as possible during packaging, thereby effectively reducing the overall packaging volume and lowering the transportation cost.

The disassembly and assembly of the hinge-type foldable assembled fence according to the present application is convenient. When the fence is stored, the annular ring can be taken out from the hook 201 with a little force, and then the fastening screw for fixing each hinge-type foldable upright rod 200 is unscrewed by a screwdriver, and then each hinge-type foldable upright rod 200 can be folded. The assembly operation is reverse to the above disassembly operation, so the whole disassembly and assembly is simple, and the detachable design of the fence is realized with a concise structure, and the packaging volume and the transportation cost are reduced.

Third Embodiment

Another separable and foldable mannequin for clothing design with easy packaging and transportation is provided in this embodiment on the basis of the second embodiment, and this embodiment includes all the contents of the second embodiment.

A split-type supporting chassis 300 is added on the basis of the mannequin provided in the second embodiment, which replaces the conventional cast-iron four-legged wheeled chassis. The structure of the split-type supporting chassis 300 in the present application is described in detail hereinafter.

Figure 12:
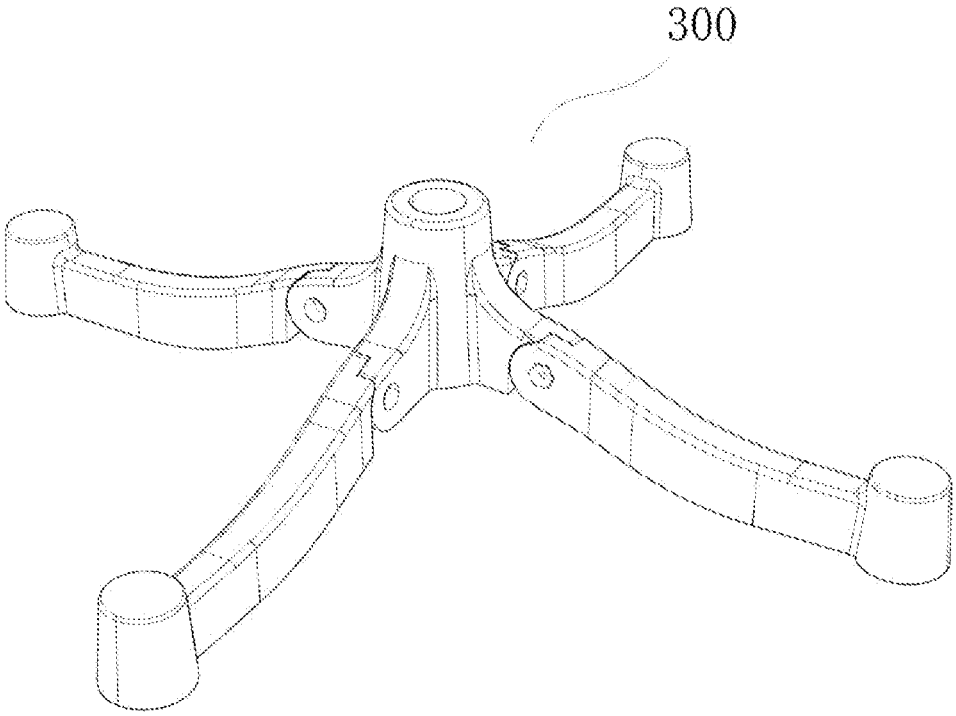
FIG. 12 is a schematic structural view of a split-type supporting chassis according to an embodiment of the present application.

Referring to FIG. 12, the split-type supporting chassis 300 according to the present application includes an intermediate connecting member 301 connected with the bottom of the split-type lifting rod device 100 and multiple supporting foot stands 303 detachably connected with the intermediate connecting member 301.

Figure 13:
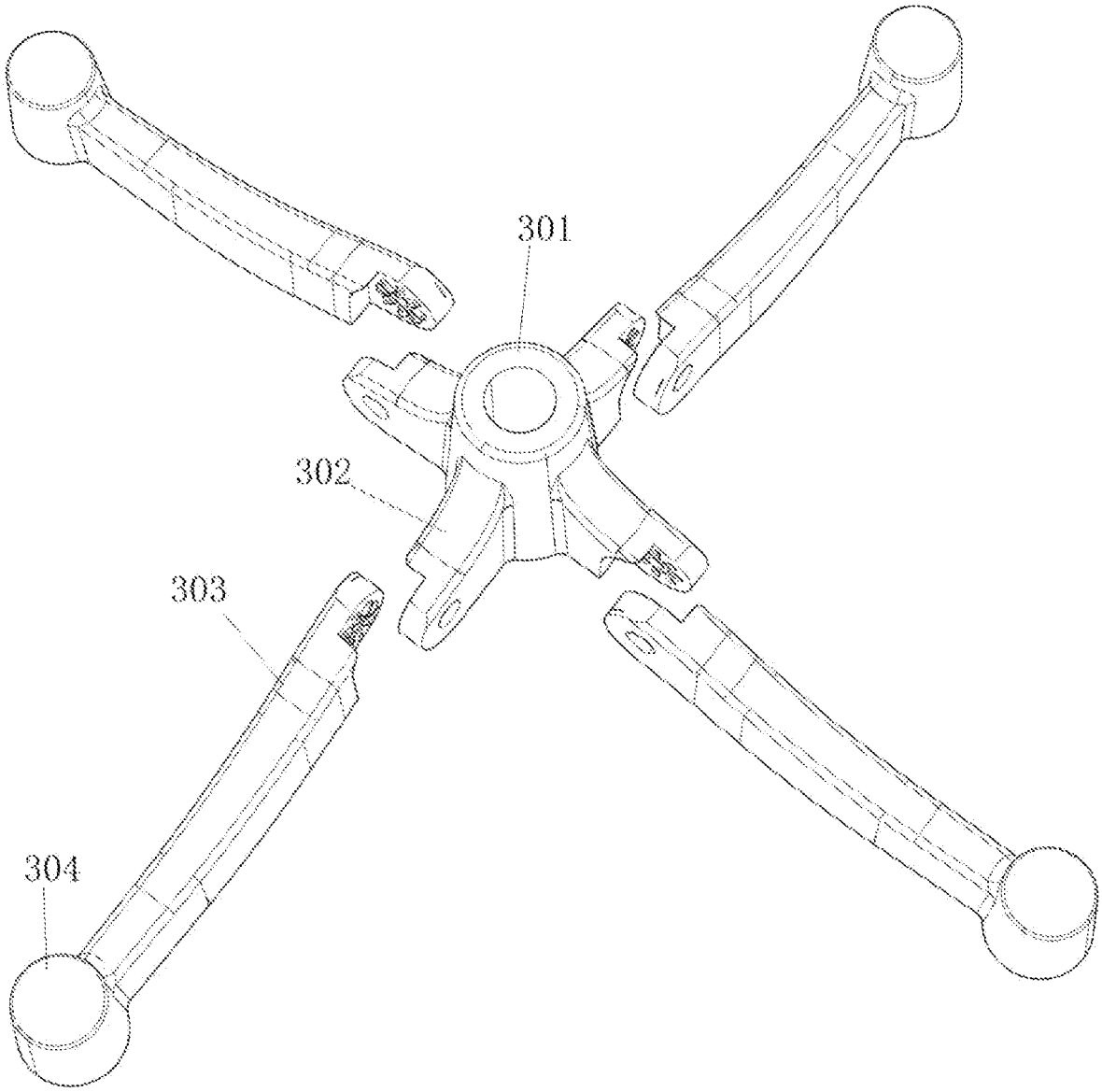
FIG. 13 is a schematic exploded view of the split-type supporting chassis shown in FIG. 12.
Figure 14:
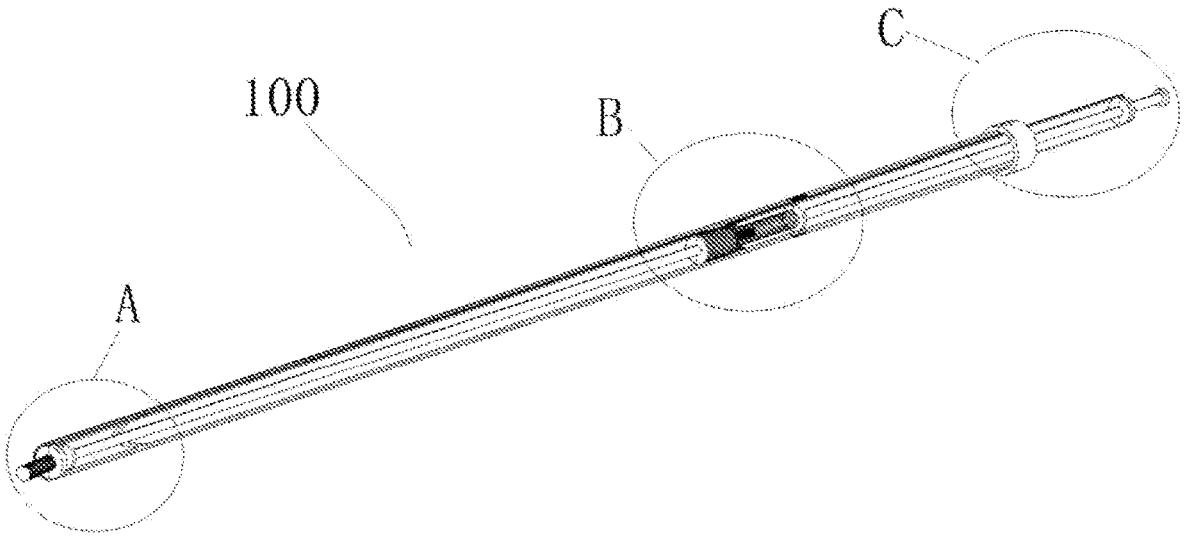
FIG. 14 is a schematic view showing the internal structure of a split-type lifting rod device according to an embodiment of the present application.

In this embodiment, referring to FIG. 13, the intermediate connecting member 301 mainly includes a central cylinder which forms a plug-in mounting position for the split-type lifting rod device 100, multiple connecting supports 302 are uniformly provided on an outer wall of the central cylinder, and one supporting foot stand 303 is mounted on each connecting support 302.

In this embodiment, four connecting supports 302 are uniformly provided on the outer wall of the central cylinder, by way of example. In other embodiments, three, five, six or other number of connecting supports 302 may be provided.

In this embodiment, a mounting dent is defined at an end, away from the central cylinder, of the connecting support 302, the mounting dent is a dent recessed inward from one side surface of the connecting support 302, and a first connecting hole extending through the connecting support 302 is defined at the bottom of the mounting dent.

In this embodiment, one end of the supporting foot stand 303 is provided with a mounting protrusion adaptively overlapped with the mounting dent. A second connecting hole corresponding to the first connecting hole is defined on the mounting protrusion, and the first connecting hole is correspondingly in communication with the second connecting hole to form a mounting passage for mounting a fastening screw when the mounting dent is adaptively overlapped with the mounting protrusion. The detachable connection between the intermediate connecting member 301 and the supporting foot stand 303 is realized by the fastening screw.

In another embodiment, a socket may be provided at an end of the connecting support 302 of the intermediate connecting member 301, and one end of the supporting foot stand 303 is configured to be inserted into the socket.

In another embodiment, an internal-threaded mounting hole is defined on the connecting support 302, an external-threaded connecting column is provided at an end of the supporting foot stand 303, so that the connecting support 302 is threadedly connected with the supporting foot stand 303.

In addition to the above connection methods, the connecting support 302 may be detachably connected with the supporting foot stand 303 by other methods, which will not be listed one by one herein.

Since each supporting foot stand 303 is detachably connected with the connecting support 302 in the present application, a mounting angle between the supporting foot stand 303 and the connecting support 302 can be manually adjusted when the ground for the user to place is uneven. Therefore, the supporting foot stand 303 can adapt to the uneven ground and ensure the angle balance of the mannequin.

In this embodiment, in order to further ensure the stability of the split-type supporting chassis 300, the other end, facing away from the connecting support 302, of the supporting foot stand 303 is provided with a supporting foot 304. The supporting foot 304 has a block structure and is hollow inside, while the supporting foot 304 has a horizontal bottom surface. The split-type supporting chassis 300 can be stably supported by the multiple supporting foot stands 303 and the supporting feet 304 thereon when the assembled split-type supporting chassis 300 is placed on the ground.

Therefore, the split-type supporting chassis according to the present application is connected with the split-type lifting rod device by the intermediate connecting member. The detachable design of the intermediate connecting member and the supporting foot stands reduces a horizontal area of the original chassis. During packaging, the split-type supporting chassis is disassembled into multiple small components, thereby reducing the overall packaging volume.

In summary, the mannequin for clothing design according to the present application has the hinge-type foldable assembled fence (which can be understood as a foldable leg frame), the detachable pedal lifting rod and the split-type supporting chassis. The overall packaging volume is reduced, the costs of packaging, transportation and storage are reduced, and the competitiveness of products is improved by the foldable and detachable design of the three modules.

In the present application, the conventional straight-rod lifting rod is replaced by the split-type lifting rod device, the fixed fence iron frame is replaced by the hinge-type foldable assembled fence, and the fixed four-legged chassis is replaced by the split-type supporting chassis. The structural improvements greatly shorten the packaging size of the product during packaging, and the assembly is simple during use of the user, without affecting the use effect. In addition, the overall appearance has no obvious change, which does not cause visual misjudgment by the user. In addition, the split-type supporting chassis according to the present application enables the user to adjust and maintain the angle balance of the product according to the unevenness of the ground.

In summary, regarding the existing technical problems, the present application proposes a new structural design in which the appearance of accessories and the lifting chassis system of the product are designed in a feasible and effective separable mode, so that the original packaging volume is greatly reduced. The packaging length of the existing mannequin after packaging is reduced from 170 cm to 95-105 cm, and the packaging width and the packaging height are unchanged, which greatly reduces the packaging size of the product, reduces the use cost of the product, improves the use interest of the user, and is beneficial to expanding the market share of the product.

The technical features in the foregoing embodiments may be combined at will (provided that they do not conflict with each other). For concise description, not all possible combinations of the technical features in the above embodiments are described. However, these embodiments that are not explicitly described shall fall within the scope of this specification.

The present application has been described in detail through general description and specific embodiments. It should be understood that based on the technical concept of the present application, some conventional adjustments or further innovations can be made to these specific embodiments. However, as long as these conventional adjustments or further innovations do not deviate from the technical concept of the present application, the technical solutions obtained by these conventional adjustments or further innovations also fall within the scope of protection of the claims of the present application.

What is claimed is:

1. A separable and foldable mannequin for clothing design with easy packaging and transportation, comprising a split-type lifting rod device, wherein the split-type lifting rod device comprises an outer tube assembly and an inner tube assembly arranged in the outer tube assembly, wherein the outer tube assembly comprises at least two outer tube sections which are detachably connected, wherein an end of the outer tube section located at one end of the outer tube assembly is provided with a bolt fixing gasket for mounting a neck tube, and a fixed sleeve is provided on the outer tube section located at the other end of the outer tube assembly, wherein a screw hole is defined on the fixed sleeve, and a through hole corresponding to the screw hole is defined on the outer tube section;

the inner tube assembly comprises at least two inner tube sections which are detachably connected, wherein an ejector pin assembly is provided in the inner tube assembly, wherein a first guide gasket which is close to the neck tube is provided at one end of the inner tube assembly, and a third guide gasket is provided at the other end of the inner tube assembly, wherein a threaded connecting sleeve is provided at a connection between two adjacent inner tube sections, and the threaded connecting sleeve is located in the inner tube sections and a spring is mounted on the threaded connecting sleeve; the inner tube section close to the neck tube comprises two splicing sub-tube sections, and a splicing joint of the two splicing sub-tube sections is a slope joint; and the ejector pin assembly comprises a first ejector pin and a second ejector pin, wherein one end of the first ejector pin is connected with the first guide gasket, and the other end of the first ejector pin passes through the threaded connecting sleeve and extends into the spring, wherein the spring abuts against a second guide gasket, the second guide gasket is connected with one end of the second ejector pin, and the other end of the second ejector pin penetrates through the third guide gasket and is connected with a pedal assembly after extending out of the inner tube assembly.

2. The separable and foldable mannequin for clothing design with easy packaging and transportation according to claim 1, wherein the two adjacent outer tube sections are threadedly connected or are correspondingly connected by insertion;

a screw is mounted in the screw hole of the fixed sleeve, and the screw abuts against an outer wall of the inner tube section;

a slope of the slope joint of the two splicing sub-tube sections is 30°;

connecting ends of the two adjacent inner tube sections are respectively provided with internal threads, external threads corresponding to the internal threads are provided on the threaded connecting sleeve, and the two inner tube sections are detachably connected with each other by the threaded connecting sleeve;

the other end, extending out of the inner tube assembly, of the second ejector pin is adaptively connected with a base, a rotating shaft for mounting the pedal assembly is provided on the base, one end of the pedal assembly is connected with the second ejector pin, and a retaining gasket is provided at a connection between the pedal assembly and the second ejector pin;

the two splicing sub-tube sections abut against each other and are misaligned by sliding along the slope joint when the pedal assembly is in an initial state, so that central axes of the two splicing sub-tube sections are misaligned, an outer wall of the two splicing sub-tube sections abuts against an inner wall of the outer tube assembly to lock the inner tube assembly and the outer tube assembly; and the first ejector pin is lifted by the spring when the pedal assembly is stepped downward, so that the two splicing sub-tube sections are separated, the central axes of the two splicing sub-tube sections coincide to unlock the inner tube assembly and the outer tube assembly, and the outer tube assembly is driven to move up and down along the inner tube assembly; and the inner tube assembly and the outer tube assembly are locked when the pedal assembly is released, completing the lifting adjustment.

3. The separable and foldable mannequin for clothing design with easy packaging and transportation according to claim 2, wherein a neck fixing disc is mounted at the end, provided with the bolt fixing gasket, of the outer tube assembly, wherein the neck fixing disc is connected with a mannequin outer housing which covers an outer side of the split-type lifting rod device, wherein a mounting hole for the neck tube to pass through is defined at the center of the neck fixing disc, external threads are formed on an outer wall of the neck tube, a top screw is adaptively connected with the external threads and is configured to fixedly connect the outer tube assembly with the mannequin outer housing, wherein the mannequin outer housing rises or falls with the outer tube assembly when the outer tube assembly is adjusted to rise or fall;

the top screw comprises a spherical connecting portion arranged at the bottom of the top screw and a conical connecting portion arranged at a top end of the spherical connecting portion, wherein a top end of the conical connecting portion is hemispherical, the spherical connecting portion and the conical connecting portion form a gourd-shaped structure; and protruding ribs are uniformly provided on an outer wall of the conical connecting portion; and internal threads are formed in the spherical connecting portion and the conical connecting portion.

4. The separable and foldable mannequin for clothing design with easy packaging and transportation according to claim 1, further comprising a hinge-type foldable assembled fence which comprises a plurality of annular rings and a plurality of hinge-type foldable upright rods; wherein the plurality of annular rings are horizontally arranged and are spaced apart vertically;

the plurality of hinge-type foldable upright rods are vertically arranged or vertically inclined, a plurality of hooks for mounting the plurality of annular rings are spaced apart on each hinge-type foldable upright rod, and the number of hooks on each hinge-type foldable upright rod is the same as the number of annular rings; and each hinge-type foldable upright rod comprises a plurality of short columns hinged to each other, lengths of the short columns are the same or different, a mounting fixing portion for connecting with the mannequin is formed on the short column located at a top end of the hinge-type foldable upright rod, and the hook for mounting the annular ring is formed on the short column located at a tail end of the hinge-type foldable upright rod.

5. The separable and foldable mannequin for clothing design with easy packaging and transportation according to claim 4, wherein the mounting fixing portion comprises a fixing seat connected at an end of the short column, a threaded connecting hole is defined on the fixing seat, and the fixing seat is tightly connected with the mannequin by a fastening screw;

any two adjacent short columns are hinged to each other, wherein an end of one short column forms a hinge head, and an end of the other short column forms a hinge seat adapted to the hinge head, wherein a mounting groove for mounting the hinge head is defined on the hinge seat, and a mounting hole for mounting a rotating shaft is defined on a groove wall of the mounting groove; and a hole for the rotating shaft to pass through is defined on the hinge head, wherein the hole on the hinge head is correspondingly in communication with the mounting hole on the mounting groove to form a passage for mounting the rotating shaft when the hinge head is mounted in the mounting groove.

6. The separable and foldable mannequin for clothing design with easy packaging and transportation according to claim 5, wherein any two adjacent short columns are rotatable around the rotating shaft, so that an included angle ranging from 90° to 180° is formed between the two adjacent short columns; and the plurality of short columns are arranged in a continuous crenellation shape when the included angle of 90° is formed between any two adjacent short columns.

7. The separable and foldable mannequin for clothing design with easy packaging and transportation according to claim 1, further comprising a split-type supporting chassis, wherein the split-type supporting chassis comprises an intermediate connecting member connected with the bottom of the split-type lifting rod device and a plurality of supporting foot stands detachably connected with the intermediate connecting member.

8. The separable and foldable mannequin for clothing design with easy packaging and transportation according to claim 7, wherein the intermediate connecting member comprises a central cylinder which forms a plug-in mounting position for the split-type lifting rod device, four connecting supports are uniformly provided on an outer wall of the central cylinder, and one supporting foot stand is mounted on each connecting support.

9. The separable and foldable mannequin for clothing design with easy packaging and transportation according to claim 8, wherein a mounting dent is formed at an end of the connecting support, the mounting dent is a dent recessed inward from one side surface of the connecting support, and a first connecting hole extending through the connecting support is defined at the bottom of the mounting dent; and one end of the supporting foot stand is provided with a mounting protrusion adaptively overlapped with the mounting dent, wherein a second connecting hole corresponding to the first connecting hole is defined on the mounting protrusion, and the first connecting hole is correspondingly in communication with the second connecting hole to form a mounting passage for mounting a fastening screw when the mounting dent is adaptively overlapped with the mounting protrusion.

10. The separable and foldable mannequin for clothing design with easy packaging and transportation according to claim 9, wherein the other end of the supporting foot stand is provided with a supporting foot, wherein the supporting foot has a block structure and a horizontal bottom surface.

* * * * *